United States Patent [19]

Kline

[11] 4,449,310

[45] May 22, 1984

[54] GOLF CLIP

[76] Inventor: Michael S. Kline, 166 N. Middaugh St., Somerville, N.J. 08876

[21] Appl. No.: 391,545

[22] Filed: Jun. 24, 1982

Related U.S. Application Data

[63] Continuation-in-part of Ser. No. 215,539, Dec. 11, 1980, abandoned.

[51] Int. Cl.[3] ..... G09F 3/18

[52] U.S. Cl. ..... 40/11 R; 281/15 B; 40/1.5; 40/306; 273/32 B; 206/315.3; 206/315.5

[58] Field of Search ..... 40/11 R, 10 R; 281/15 B; 150/1.5 R; 273/32 B

[56] References Cited

U.S. PATENT DOCUMENTS

| | | | |
|---|---|---|---|
| 251,966 | 1/1882 | Tait | 40/11 R |
| 1,815,024 | 7/1931 | Foster | 40/11 R |
| 1,973,819 | 9/1934 | Link | 224/918 |
| 2,566,837 | 9/1951 | Huelsmeyer | 40/11 R |
| 2,604,724 | 7/1952 | Watts | 281/15 B |
| 2,636,751 | 4/1953 | Carlson | 150/1.5 R |
| 3,298,579 | 1/1967 | Smith | 224/918 |
| 3,830,415 | 8/1974 | Jacobson et al. | 224/918 |

FOREIGN PATENT DOCUMENTS

| | | | |
|---|---|---|---|
| 667961 | 8/1963 | Canada | 224/918 |
| 419588 | 1/1911 | France | 40/11 R |

*Primary Examiner*—Gene Mancene
*Assistant Examiner*—Wenceslao J. Contreras
*Attorney, Agent, or Firm*—Scully, Scott, Murphy & Presser

[57] ABSTRACT

A golf clip including a member of spring-like material which is adapted to be resiliently removably mounted on a support structure. The member is designed to resiliently removably hold a golf score card thereon and has a receptacle for receiving and removably retaining a scoring implement. The member is in the form of an elongated strip of spring material including a first leg having a free end and the other end bent into a second leg overlying the first leg to form a mounting recess to receive the support structure therebetween and mount the clip thereon. The second leg is bent at the end opposite to the end connected to the first leg to form a third leg overlying the second leg at the side opposite to the side facing the first leg. The second and third legs are adapted to resiliently hold the golf score card therebetween. The end of the third leg opposite to the end connected to the second leg is bent into a hollow tubular configuration to receive and retain a marking implement therein. An alternative form includes a reduced diameter third leg to provide a pair of marginal edge portions having apertures therein for removably holding a pair of golf tees.

6 Claims, 6 Drawing Figures

FIG.1
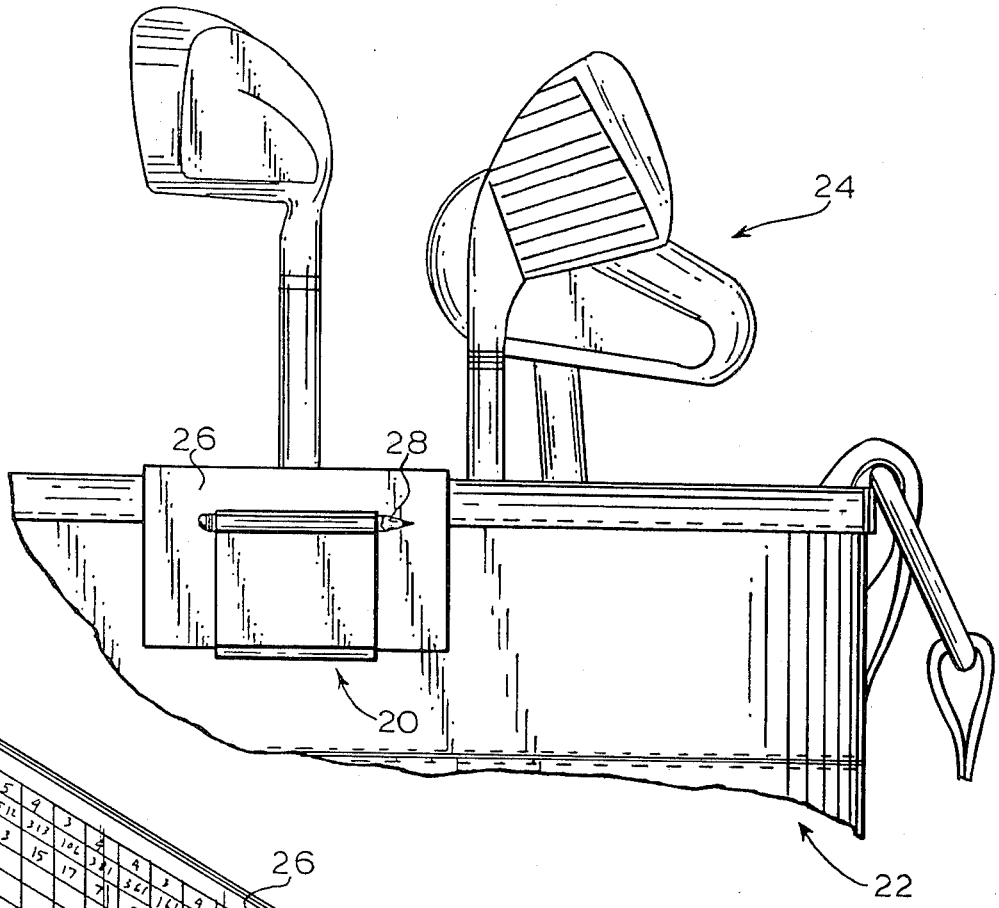
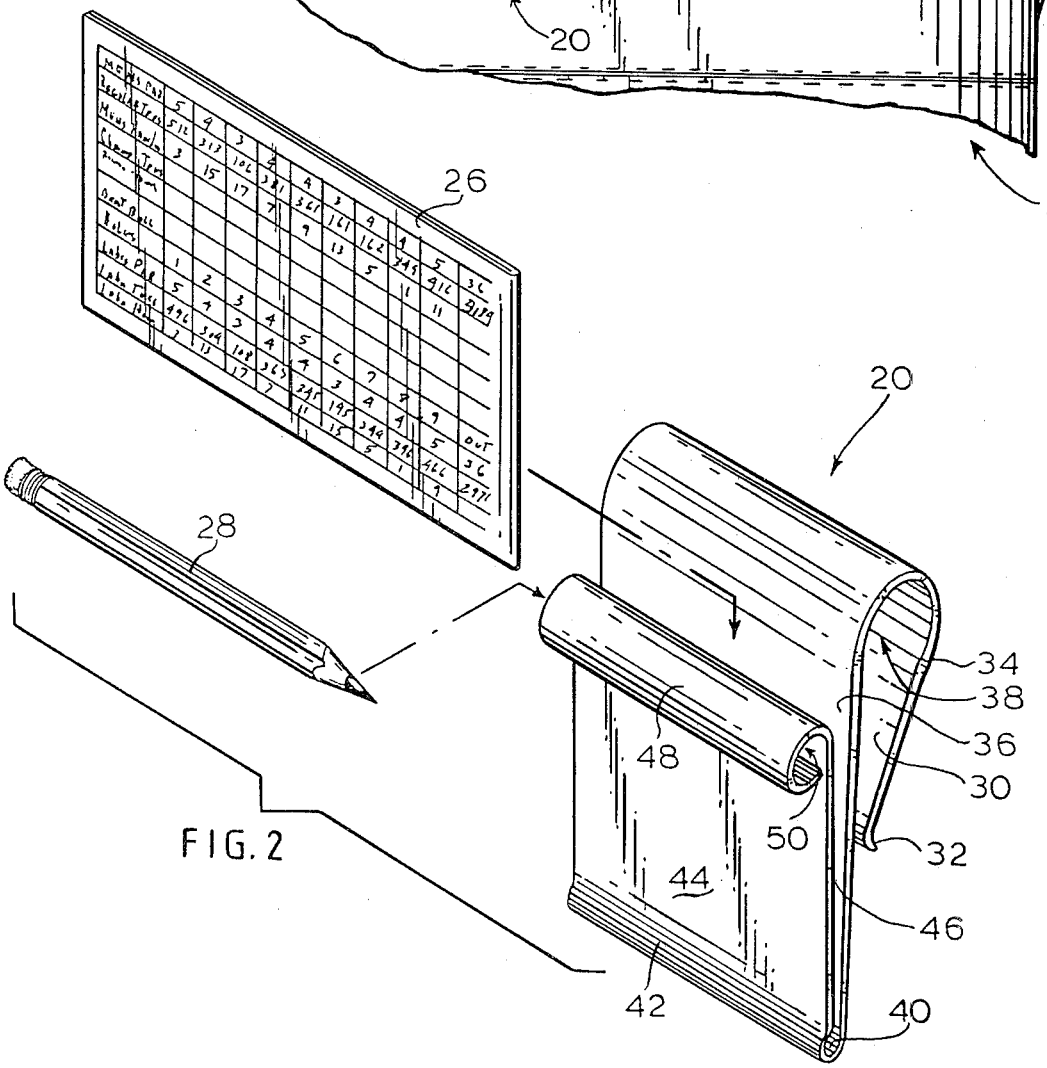
FIG. 2

FIG.4
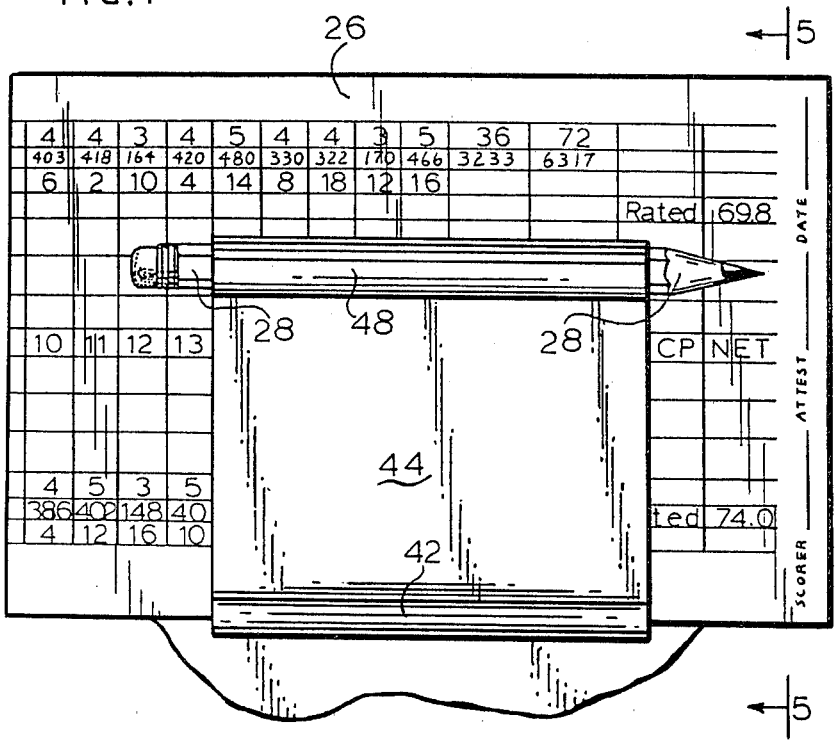
FIG.5
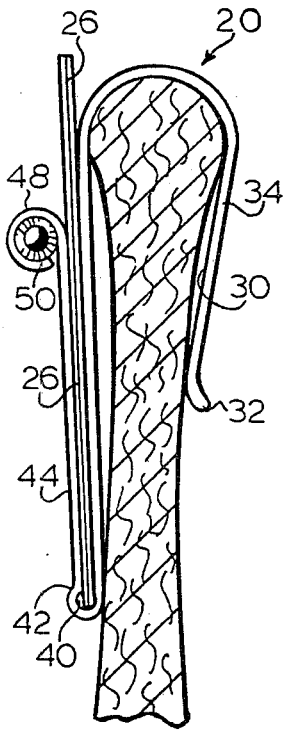
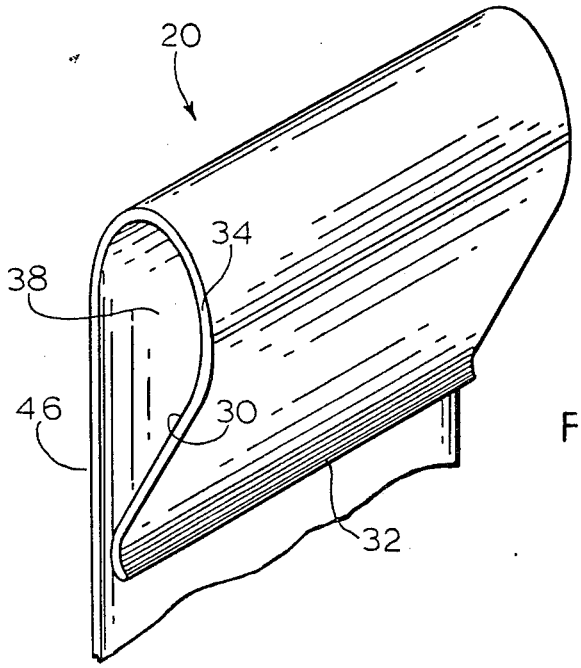
FIG.3

GOLF CLIP

This is a continuation-in-part application of Ser. No. 215,539 filed Dec. 11, 1980 and now abandoned.

BACKGROUND OF THE INVENTION

One important part of golf equipment used by all golfers during a round of play is a golf score card. The score card is designed to provide locations to mark the cumulative strokes per hole and to record comparative scores of playing companions. Additionally, the score cards often provide useful information for the golfer such as handicap ratings of the holes and the length of each hole. This later information is extremely helpful in selection for individual shots at various locations on the course. Other information is sometimes provided on the score card as well such as local rules pertaining to the golf course and schematic layouts of the holes to be played. These are additional valuable guides for the golfer.

A difficulty arising with use of a score card deals with finding a convenient place to store the card when it is not being used. The card is generally handsize, semi-rigid, and rectangular in configuration. Naturally, it cannot be held in the golfer's hand while playing. Also, the writing implement, generally a pencil, presents a similar problem when not in use. The pencil is only required when a score is to be recorded which is rather infrequent during a round of golf. Additionally, the pencil contains a sharp point and the card is relatively rigid and, thus it is undesirable to keep them in a pocket when vigorous movement is required in playing golf. Also, golf tees present similar problems when not being used. They are small sharp pointed devices that are only needed for the initial golf stroke on most holes. However, both the pencil and the tee should be readily available when needed.

A variety of golf accessory equipment has been developed for holding score cards. For example, when an electric cart is employed, a support and clip is often provided on the steering column within the circumference of the steering wheel. Where pull carts are used, supports have been provided on the cart with an appropriate clip to hold the score card in position. In both instances the structures are designed to hold the score card and/or the pencil and free the golfer's hands for playing the round of golf. Generally these devices form fixed portions of the structures. Also, the devices are expensive, particularly, where they are constructed as part of the pull cart or the electric golf cart. The individual devices are also restricted to use with the particular type of vehicle being used whether it be a pull cart or an electric cart. Consequently if neither is being used there is no available support structure for the score card.

Examples of more versatile clip designs appear in U.S. Pat. Nos. 2,658,773; 2,528,695; 2,636,751; and 4,114,925. However, these devices still lack the desired simplicity, portability, efficiency, and cost savings in design. Improvement in clip design is needed. Examples of the history of development of clip design over the years can be ascertained from U.S. Pat. Nos. 1,376,753; 1,563,508; 1,663,120; 1,817,424; 1,828,417; 2,202,267; 2,211,879; 2,329,974; 2,526,297; 2,549,200; 2,566,837; 3,195,253; 3,539,204; 4,034,539; and 4,156,318. These clip designs as developed in non-golf areas show no suggestion of applicability to golf equipment for handling golf score cards, tees and pencils.

Accordingly, there is clearly a need for an improved golf holding device or clip for holding a score card and a writing implement, and, if desired one or more tees, and, which is a small, mobile, lightweight, low cost, device and can be easily and quickly attached to a variety of different types of support structures such as golf bags, and various types of golf carts. Accordingly, the device should be portable and yet provide means for attachment to the support structure while also providing means for holding the score card, a writing implement and/or a tee in a manner which will permit their easy removal for consultation by the golfer and marking of the score or teeing off on a hole.

SUMMARY OF THE INVENTION

With the above background in mind, it is among the primary objectives of the present invention to provide a simple, low cost, portable and versatile golf clip. The clip is designed to be mounted on a variety of different types of support structures such as a golf bag, a golf pull cart or an electric cart. A further objective of the present invention is to provide a golf clip formed of a single unitary piece of material, such as a spring metal, and which provides means for resiliently mounting the clip on the support structure, has means for resiliently mounting and holding a score card and means for resiliently engaging a writing implement such as a pencil. The unitary structure which resiliently holds in this manner also facilitates release of the score card and of the pencil from the support structure.

The golf clip of the present invention is small, lightweight and easy to handle and is portable and can be transported and quickly and efficiently attached to a variety of different support structures. The clip is designed so that the score card and the pencil are readily accessible. Also, when mounted on the golf bag or the like, it will not interfere with the golfer's normal activities in playing his round of golf.

In summary, a golf clip is provided which includes a member of spring-like material with mounting means on the member for resiliently removably mounting the member on a support structure. The member has holding means thereon for resiliently removably holding a golf score card on the clip. Receptacle means is on the member for receiving and removably retaining a marking implement to be used in recording a score on the score card.

More specifically, the member is in the form of an elongated strip of spring material including a first leg having a free end and the other end bent into a second leg overlying the first leg to form a mounting recess to receive a support structure therebetween and mount the clip thereon. The second leg is bent at the end opposite to the end connected to the first leg to form a third leg overlying the second leg on the side opposite to the side forming the first leg. The second and third legs are adapted to resiliently hold a golf score card therebetween. The end of the third leg opposite to the end connected to the second leg is bent into a hollow tubular configuration to receive and retain a marking implement therein.

In an alternative form, the clip is designed to removably hold at least one golf tee in readily accessible position. Also, the golf tee is held on the clip in a position where it does not interfere with handling of the golf bag or removal and insertion of golf clubs with respect to the golf bag by the user during a round of golf.

In the alternate form, the third leg which terminates in the hollow tubular configuration for the marking implement is formed of lesser diameter than the second leg. The portion of the bend between the second and third leg which extends from the second leg produces a marginal part adjacent each lateral edge of the clip. This marginal edge portion is provided with an aperture large enough to receive the lesser diameter shank portion of a tee but not the larger head portion. Thus, a golf tee can be inserted in either or both of the apertures at the marginal edge portions of the bend in the clip where each tee is retained in position for easy and efficient use. It is also contemplated that a resilient receptacle collar can be mounted in each of the apertures to facilitate resilient interengagement with the tee to retain the tee in position until the time of use. This is particularly useful when the clip is mounted on a golf bag and the golf bag is subjected to significant jostling and handling during the golfing round.

Additionally, the location of the tees in the apertures in the marginal parts of the bent provide for maintaining the tees in a position removed from interferring engagement with the golf card held between the second and third legs on the clip. Thus, whether or not the tees are present in either or both of the apertures does not affect the ease of handling and use of the golf card. The same holds true for the marking implement. The golf tees held in the apertures in the clip are spaced from the location of the marking implement so that removal and insertion of the implement in its holding tube is not interfered with. Similarly, this spacing also avoids any difficulty and interference with the tees when one is to be used. They can be easily removed and inserted without affecting the fixed position of the marking pencil and the score card.

The score card is held in the alternate clip in the same manner as in the first discussed embodiment fixed between the second and third leg and the clip is mounted in the same manner on the golf bag.

It is also an objective of the present invention to provide an improved golf bag formed with a removable clip thereon of the above described types for use in holding a score card, a marking implement, and/or golf tees on the bag. The score card, working implement, and tees can each be individually easily removed for use and replaced thereafter. The clip and the items it holds are in a position on the bag where they do not interfere with golf club selection.

All of the above embodiments of the present invention involve an inexpensively formed golf clip of a single piece of material which can be easily and efficiently utilized.

With the above objectives among others in mind, reference is made to the attached drawings.

BRIEF DESCRIPTION OF THE DRAWINGS

In the Drawings:

FIG. 1 is a perspective view of a golf bag containing golf clubs therein and having the clip of the invention mounted thereon;

FIG. 2 is a perspective view of the clip of the invention and a score card and pencil usable therewith;

FIG. 3 is a fragmentary perspective view of the clip of the invention;

FIG. 4 is a fragmentary side elevation view of the clip of the invention mounted on a golf bag and holding a score card and a pencil as shown in FIG. 1;

FIG. 5 is a sectional view thereof taken along the plane of line 5—5 of FIG. 4.

DETAILED DESCRIPTION

Figure 6:
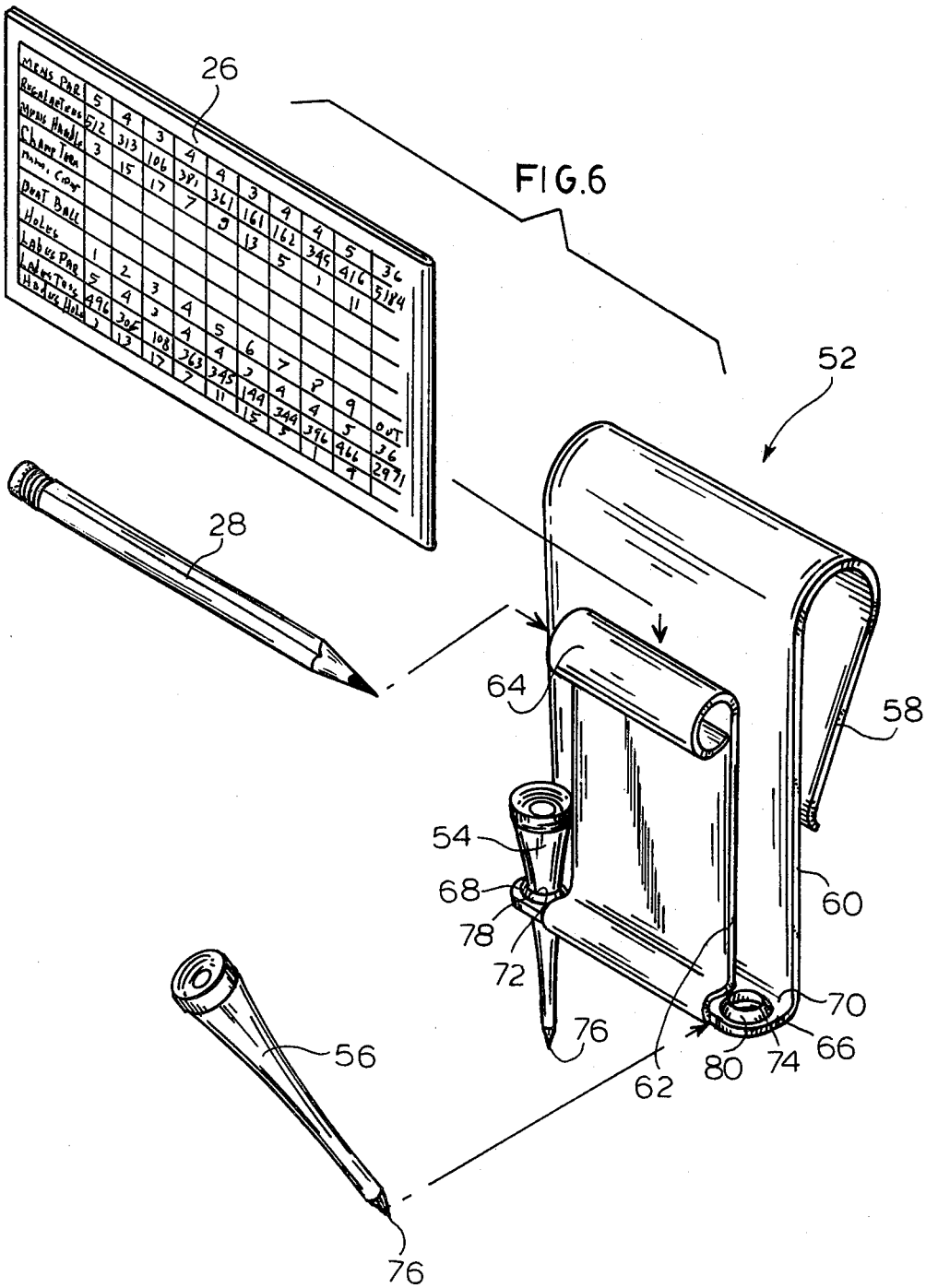
FIG. 6 is a perspective view of an alternative clip of the invention and a score card, pencil and golf tees usable therewith.

Golf clip 20 is shown in FIG. 1 attached to a conventional golf bag 22 containing a conventional arrangement of golf clubs 24. More specifically, the clip 20 is attached to the upper edge of the side wall of the golf bag 22. In this position, it is easily accessible for holding and removing a conventional golf score card 26 and a golf marking pencil 28. Furthermore, the score card and marking pencil are attached to the bag in a position where they will not interfere with the golfer's normal use of the bag and the clubs contained therein.

Clip 20 can be formed of any conventional well known resilient material such as spring steel, resilient aluminum, resilient plastic, or any conventional substitute therefor. Preferably it is formed of a low cost material and is formed as a single piece of spring-like material.

The clip includes a first leg 30 having a free end 32. Leg 30 is relatively straight and rectangular in configuration and terminates in a curved loop portion 34. Loop 34 is formed by a bend in the strip of spring material so that the opposite end of the loop from the first leg 30 extends into a second leg 36 in overlying position with respect to the first leg. The second leg 30 is also relatively rectangular in configuration and extends beyond the free end 32 of the first leg 30. Loop 34 is formed so that the first leg 30 tends to extend inwardly as it extends along the adjacent surface of the second leg 36 so as to form a recess 38 therebetween for receiving the upper edge of the golf bag when mounting the clip thereon.

The end 40 of the second leg distal from the loop 38 is bent back upon itself in the form of a smaller loop 42 so as to form a third leg 44 in overlying and spaced relationship with the second leg 36. The second leg 36 and the third leg 34 form a recess 46 therebetween for insertion of a core card 26. The resilient nature of the material of clip 20 will cause legs 44 and 36 to resiliently retain the score card in position therebetween.

The remaining free end of the clip which is the free end of leg 44 is curved back upon itself on the side opposite to the side of leg 44 facing leg 36. It is turned back upon itself to form a hollow tubular configuration 48. This tube 48 is open at both ends and is formed so that the free edge 50 of the clip is turned inward against the face of third leg 44 opposite to the adjacent face of second leg 36. The diameter of the tube is predetermined so that it will resiliently hold a marking pencil 28 extended through either of the open ends. The resilient nature of the spring-like material of clip 20 will facilitate the engaging and holding of the pencil in position while resiliently permitting its removal for use.

It will be noted that all edge surfaces of the clip are formed in arcuate shapes to minimize sharp edges and the danger of injury to the user or to any adjacent clothing or other perishable material. Clip 20 is small and easy to handle being formed of an inexpensive light weight material. It has a size which permits its ease of portability since it is designed to be hand-held.

The clip 20 is mounted on the golf bag 22 in a quick and efficient manner. The opening to recess 38 between legs 30 and 36 is positioned adjacent to the upper edge of the side wall of the golf bag 22 and sufficient force is applied to the clip to permit the golf bag to force the legs 30 and 36 apart and the upper side wall portion of the bag to extend inward between legs 30 and 36 until it engages with the undersurface of loop 34. The tendency of legs 30 and 36 to return into close lying relationship with one another will provide resilient interengagement with the bag and hold the clip in position. This condition is shown in FIG. 5 of the drawings.

Score card 26 can be mounted in a similar manner by aligning the card 26 with the opening to recess 46 between legs 36 and 44 and applying sufficient force to separate legs 44 and 46 and permit the score card to rest within recess 46 and against loop 42. The tendency of the resilient legs 44 and 36 to return to their initial relaxed position in close lying relationship with one another will cause them to engage the score card and resiliently hold the card in position.

Pencil 28 is inserted through either open end of tube 48. The inner diameter of tube 48 is slightly smaller than the outer diameter of the pencil 28 when in relaxed condition. In this manner, insertion of the pencil will cause tube 48 to expand slightly which is permitted by the free end 50 of the clip. Thereafter, the tendency of the tube 48 to return to its initial configuration will engage and frictionally hold the pencil 28 in position.

Naturally, the pencil can be easily removed by exerting sufficient force to overcome the frictional resilient holding of the tube and the score card can be removed in a similar manner to overcome the frictional resilient holding of legs 44 and 36. The clip itself can be easily removed in a similar manner by exerting sufficient force to overcome the resilient holding of legs 30 and 36 on the golf bag 22. Thus, the clip can be quickly and efficiently mounted on a variety of different supporting structures and the score card and pencil are readily accessible for use and remounting on the clip.

One effective dimensional example of a clip which will operate successfully as a golf scorecard and pencil holder is one formed of a single piece of spring steel which has a first leg which is approximately 3¼ inches long terminating in its closed end in a loop which is approximately 1 inch long and ¾ inch in diameter. The loop extends into a second leg which is approximately 3 inches long and terminates in a smaller loop approximately 5/32 inch in diameter. The smaller loop extends into the third leg which is approximately 2 inches long and terminates at the pencil holding tube which is approximately 9/32 inch in diameter. A clip of this dimensional structure would be approximately 2 inches in width. The smaller second loop would be approximately a ¼ inch in length and the pencil tube loop would be approximately ½ inch in length.

It should also be noted that in the preferred embodiment of the present invention the third and first legs are shorter than the second leg. This facilitates retention of the pencil and score card below the upper edge of the golf bag and minimize the danger of interference with the golfer's normal activity in selecting and returning clubs to the bag. Also, the clip is designed so that the score card can be mounted in a horizontal position and below the upper edge of loop 34 which is attached to the upper edge of the bag. Once again this is to facilitate avoiding any danger of interference between the clip or the items it is holding and the golfer in carrying out his normal activities in club selection and playing his golf shots.

FIG. 6 of the drawing shows an alternative embodiment in the form of golf clip 52. Clip 52 is similar in many respects to clip 20 of FIGS. 1–5 in that it is designed in the same manner to be mounted on golf bag 22 and to hold golf card 26 and pencil 28. However, it includes certain modifications in order to enable it to act as a holder for golf tees 54 and 56.

Clip 52 is formed of a one piece of spring material, as is clip 20, and is mounted on golf bag 22 by inserting the upper end of the golf bag between resilient first leg 58 and second leg 60. The score card 26 is retained in position between second leg 60 and resilient third leg 62. The marking implement 28 is housed within the tubular free end 64 of third leg 62.

However, instead of making all three legs of substantially the same width, third leg 64 has a reduced width which can be formed by cutting or otherwise removing a predetermined amount of material at the side edge portions of the third leg between the bent portion 66 connecting it to the second leg and its free end. This provides a pair of marginal edge parts 68 and 70 at the bend between the second and third legs which is located at the bottom of the clip 52 when it is mounted on golf bag 22.

A substantial portion of the width of leg 62 is retained so that it will hold golf card 26 and pencil 28 in a similar manner as clip 20.

An aperture 72 is provided in marginal edge part 68 and a similar aperture 74 is provided in marginal edge part 70. Apertures 72 and 74 are larger in diameter than the smaller end of a golf tee but smaller than the wider head portion of the tee since the golf tee is tapered in configuration. Thus, the pointed smaller end 76 of either tee 54 or 56 is insertable into aperture 72 or 74 until the tapered tee becomes too large and frictionally engages the edge of the aperture. This occurs approximately half the length of the tee and in this position the tee is held on the clip ready for use. At that time, the tee is grasped at the head end and removed from the aperture by withdrawing the smaller diameter end of the tee back through the aperture. The tees 54 and 56 can be interchangeably mounted in apertures 72 and 74 of the clip.

To facilitate holding of the tees in fixed position, a resilient collar 78 is mounted in aperture 72 and a similar collar is mounted in aperture 74. Engagement between the collar and the side walls of the tee will cause resilient frictional interengagement and help maintain the tee in position during normal handling and jostling of the golf bag. The collar can be formed of rubber or plastic and can be snap fit into position in a conventional manner.

When tees 54 and 56 are held in clip 52 they are located at the bottom of the clip and spaced from the location of the clubs 24 thus avoiding any interference with club selection. Also, the apertures are spaced from second leg 60 a sufficient distance so that the tees are spaced from the golf card 26 held in the clip avoiding interference in that respect. Furthermore, the tees 54 and 56 are held below and spaced from tube 64 holding pencil 28 thus avoiding any interference therebetween. Accordingly, three separate elements of a golfer's accessory equipment are held in readily accessible position without interference therebetween when retained in that position or when being removed for use or replaced.

The reduction in width of the third leg 62 is sufficient to accommodate the width of the widest dimension on a golf tee on each side of the clip and permit the tee's removal and insertion without interference. The remainder of the width of third leg 62 is retained to provide the desired holding engagement with card 26 and pencil 28.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

I claim:

1. A golf clip for a golf bag containing golf clubs comprising; an elongated strip of spring material, the strip being formed into a configuration including a first leg having a free end and bent at the other end into a second leg overlying the first leg to form a mounting recess to receive the upper end of the golf bag therebetween, the configuration of the mounting recess conforming to the configuration of the upper end of the golf bag and insertion of the golf bag into the recess will force the first and second legs apart whereby the tendency to return to the relaxed configuration will resiliently mount the clip on the golf bag, the second leg being bent at the end opposite to the end connected to the first leg to form a third leg overlying the second leg on the side opposite to the side forming the first leg, the second and third legs being resiliently displaceable from one another to permit insertion of a golf score card therebetween and to hold the score card in position, the end of the third leg opposite to the end connected to the second leg being bent into a hollow tubular configuration to receive and retain a marking implement for the score card therein, the third leg being shorter than the second leg to provide access to the golf card held in the clip for marking of indicia thereon and to space the marking implement from the upper end of the golf bag on which the clip is mounted, the first leg being shorter than the second leg thereby minimizing interference with golf club selection with respect to the golf bag, the recess between the second and third legs for holding the golf card being open at both side edges to permit use of the clip with a variety of different size golf cards, the third leg having a reduced diameter width with respect to the second leg so as to provide at least one spaced marginal edge part at the bend connecting the second leg to the third leg, and an aperture in each of the spaced marginal edge parts so as to permit partial insertion of a golf tee therein to hold the golf tee in position on the clip and permit removal of the golf tee for use.

2. The invention in accordance with claim 1 wherein a resilient collar is mounted in each aperture to facilitate engagement and holding of a golf tee therein.

3. The invention in accordance with claim 1 wherein there are two spaced marginal edge parts and the apertures in each is spaced from the card and marking implement held by the clip so as to avoid interference therebetween and spaced from the upper edge of the golf bag so as to avoid interference with removal and insertion of golf clubs with respect thereto.

4. A golf bag comprising an elongated continuous side wall, a closed bottom end and an open top end to permit the insertion and removal of a plurality of golf clubs, a golf clip removably mounted on the upper end of the golf bag adjacent the open end thereof, the golf clip including an elongated strip of spring material, the strip being formed into a configuration including a first leg having a free end and bent at the other end to a second leg overlying the first leg to form a mounting recess to receive the upper end of the golf bag therebetween, the configuration of the mounting recess conforming to the configuration of the upper end of the golf bag and insertion of the golf bag into the recess forces the first and second legs apart whereby the tendency to return to the relaxed configuration resiliently mounts the clip upon the golf bag, the second leg being bent at the end opposite to the end connected to the first leg to form a third leg overlying the second leg on the side opposite to the side forming the first leg, the second and third legs being resiliently displaceable from one another to permit insertion of a golf score card therebetween and to hold the score card in position, the end of the third leg opposite to the end connected to the second leg being bent into a hollow tubular configuration to recieve and retain a marking implement for the score card therein, the third leg being shorter than the second leg to provide access to the golf card held in the clip for marking of indicia thereon and to space the marking implement from the upper end of the golf bag on which the clip is mounted, the first leg being shorter than the second leg thereby minimizing interference with golf club selection with respect to the golf bag, the recess between the second and third legs for holding the golf card being open at both side edges to permit use of the clip with a variety of different size golf cards, the third leg having a reduced diameter width with respect to the second leg so as to provide at least one spaced marginal edge part at the bend connecting the second leg to the third leg, and an aperture in each of the spaced marginal edge parts so as to permit partial insertion of a golf tee therein to hold the golf tee in position on the clip and permit removal of the golf tee for use.

5. The invention in accordance with claim 4 wherein a resilient collar is mounted in each aperture to facilitate engagement and holding of a golf tee therein.

6. The invention in accordance with claim 4 wherein there are two spaced marginal edge parts and the aperture in each is spaced from the card and marking implement held by the clip so as to avoid interference therebetween and spaced from the upper edge of the golf bag so as to avoid interference with removal and insertion of golf clubs with respect thereto.

* * * * *